US007426993B2

(12) United States Patent
Coldrey et al.

(10) Patent No.: US 7,426,993 B2
(45) Date of Patent: Sep. 23, 2008

(54) CONTACT LENS PACKAGE

(75) Inventors: Pete Coldrey, Southampton (GB); Jamie Snell, Southampton (GB)

(73) Assignee: Coopervision International Holding Company, LP, St. Michael (BB)

( * ) Notice: Subject to any disclaimer, the term of this patent is extended or adjusted under 35 U.S.C. 154(b) by 12 days.

(21) Appl. No.: 11/200,862

(22) Filed: Aug. 9, 2005

(65) Prior Publication Data

US 2007/0034533 A1 Feb. 15, 2007

(51) Int. Cl.
*A45C 11/04* (2006.01)

(52) U.S. Cl. ..... 206/5.1

(58) Field of Classification Search ..... 206/5.1, 206/438, 205, 316.1, 524.1; 134/901; 351/160 H
See application file for complete search history.

(56) References Cited

U.S. PATENT DOCUMENTS

| | | | |
|---|---|---|---|
| 4,691,820 | A | 9/1987 | Martinez |
| 4,761,069 | A | 8/1988 | Truong et al. |
| 5,054,610 | A | 10/1991 | Ajello |
| 5,337,888 | A | 8/1994 | Morrison |
| 5,375,698 | A | 12/1994 | Ewart |
| 5,409,104 | A | 4/1995 | Lovell |
| 5,467,868 | A | 11/1995 | Abrams et al. |
| 5,515,964 | A | 5/1996 | Bauman |
| 5,573,108 | A | 11/1996 | Hamilton et al. |
| 5,609,246 | A | 3/1997 | Borghorst et al. |
| 5,620,088 | A | 4/1997 | Martin et al. |
| 5,695,049 | A | 12/1997 | Bauman |
| 5,697,495 | A | 12/1997 | Abrams et al. |
| 5,704,468 | A | 1/1998 | Lust et al. |
| 5,711,416 | A | 1/1998 | Bauman |
| 5,722,536 | A | 3/1998 | Pierce et al. |
| 5,823,327 | A | 10/1998 | Wu et al. |
| 5,983,608 | A | 11/1999 | Wu et al. |
| 6,029,808 | A | 2/2000 | Peck et al. |
| 6,044,966 | A | 4/2000 | Haase |
| 6,401,915 | B1 | 6/2002 | Faxe |
| 6,413,334 | B1 | 7/2002 | Rittner et al. |

(Continued)

FOREIGN PATENT DOCUMENTS

| | | |
|---|---|---|
| EP | 0 765 815 A2 | 11/2001 |

(Continued)

OTHER PUBLICATIONS

U.S. Appl. No. 11/200,848, filed Aug. 9, 2005.

(Continued)

*Primary Examiner*—J. Gregory Pickett
(74) *Attorney, Agent, or Firm*—Stout, Uxa, Buyan & Mullins, LLP; Frank J. Uxa

(57) ABSTRACT

A blister package housing a contact lens is described. The package generally includes a base member including a cavity having a bottom surface, for containing a contact lens immersed in a liquid medium. The base member can include a grip region including a curved top surface shaped to accommodate a thumb and a curved bottom surface shaped to accommodate an inner curve of a forefinger. Silicone hydrogel contact lenses located in the liquid medium have a reduced tendency to stick to the bottom surface of the cavity without requiring a surfactant and/or a surface modification of the bottom surface.

19 Claims, 3 Drawing Sheets

U.S. PATENT DOCUMENTS

| | | | | |
|---|---|---|---|---|
| 6,432,217 | B1 | 8/2002 | Baxter et al. | |
| 2002/0016383 | A1* | 2/2002 | Iwata et al. | 523/106 |
| 2002/0046958 | A1 | 4/2002 | Lipscomb et al. | |
| 2003/0029736 | A1* | 2/2003 | Phillips et al. | 206/5.1 |
| 2003/0186825 | A1* | 10/2003 | Mitani et al. | 510/112 |
| 2004/0031701 | A1 | 2/2004 | Peck et al. | |
| 2005/0171232 | A1 | 8/2005 | Ford et al. | |
| 2006/0260956 | A1* | 11/2006 | Stachowski et al. | 206/5.1 |

FOREIGN PATENT DOCUMENTS

| | | |
|---|---|---|
| WO | WO 2004/060099 | 7/2004 |

OTHER PUBLICATIONS

U.S. Appl. No. 11/200,648, filed Aug. 9, 2005.
U.S. Appl. No. 11/200,644, filed Aug. 9, 2005.
U.S. Appl. No. 11/201,410, filed Aug. 9, 2005.
U.S. Appl. No. 11/200,863, filed Aug. 9, 2005.
U.S. Appl. No. 11/201,409, filed Aug. 9, 2005.
U.S. Appl. No. 60/604,961, filed Aug. 27, 2004.
U.S. Appl. No. 60/621,525, filed Oct. 22, 2004.

* cited by examiner

CONTACT LENS PACKAGE

The present invention relates to contact lenses and more specifically relates to packages, such as blister packs, for containing at least one contact lens.

BACKGROUND

The packaging of hydrophilic contact lenses in a sterile aqueous solution is well known in the contact lens manufacturing technology. In particular, such packaging arrangements generally consist of so-called blister packages which are employed for the storage and dispensing of hydrophilic contact lenses by a medical practitioner or a consumer who intends to wear the contact lenses. Generally, such hydrophilic contact lenses, which may be disposable after a single wear or short-term use, are manufactured from suitable hydrophilic polymeric materials, such as hydroxyethyl methacrylate (HEMA). Generally, such contact lenses must be stored in a sterile aqueous solution, usually in isotonic saline solution in order to prevent dehydration and to maintain the lenses in a ready-to-wear condition.

Heretofore, contact lens manufacturers normally utilized stoppered glass bottles containing sterile saline solutions in which the hydrophilic contact lenses were immersed. Each bottle was sealed with a suitable silicone stopper and provided with a metal closure as a safety seal in the configuration of an overcap. When the contact lens was intended to be removed from the bottle for use by a patient, the metal closure safety seal was required to be initially torn off the bottle, thereafter the stopper withdrawn and the lens lifted out from the bottle through the intermediary by a suitable tweezer or by pouring the contents from the bottle. This entailed the implementation of an extremely complicated procedure, since the contact lens was difficult to grasp and remove from the saline solution contained in the bottle due to the transparent nature of the contact lens which rendered it practically invisible to the human eye.

More recently, containments in the form of blister packages have been developed for hydrophilic contact lenses, and which enable the storage and shipping of the hydrophilic contact lenses in a simple and inexpensive expedient manner, while concurrently facilitating the removal of the contact lens by a practitioner or a patient.

For instance, a blister package which is adapted to provide a sterile sealed storage environment for a disposable or single-use hydrophilic contact lens, wherein the lens is immersed in a sterile aqueous solution, for example, such as in an isotonic saline solution, is described in Martinez, U.S. Pat. No. 4,691,820. Additional contact lens packages are disclosed in U.S. Pat. Nos. 4,691,820; 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

Contact lens packages are typically formed from hydrophobic packaging materials, such as polypropylene, polyethylene, nylons, olefin co-polymers, acrylics, rubbers, urethanes, polycarbonates, and fluorocarbons.

Silicone hydrogel contact lenses (i.e., contact lenses which comprise a silicone hydrogel material or a hydrophilic silicon containing polymer) can be stored in packages formed of hydrophobic packaging materials. However, since silicone hydrogel contact lenses are typically made of hydrophobic materials, the contact lens will often stick or adhere to the packaging material when a surface of the contact lens and a surface of the packaging material contact. The sticking of the silicone hydrogel contact lens to the package causes many problems, including an increased chance that the lens will tear when removed from the package.

To attempt to reduce the tendency for silicone hydrogel contact lenses to stick to hydrophobic packaging materials, surfactants have been added to the contact lens packaging solution, see U.S. Patent Pub. No. 2005/0171232. Not all surfactants achieve the desired reduced tendency to stick, and some surfactants do not dissolve completely in the lens packaging solution and/or distort certain properties of the lenses.

Another attempt at reducing the tendency for silicone hydrogel contact lenses to stick to hydrophobic packaging materials is to physically or structurally alter the bottom surface of the package cavity. For example, certain packages have been produced that comprise one or more ridges or one or more grooves on the bottom surface of the cavity.

Thus, there remains a need for improved contact lens packages, particularly, contact lens packages that are suitable for storage of lenses, for example, silicon-containing polymeric contact lenses.

SUMMARY OF THE INVENTION

The present invention addresses this need. It has been discovered that the present contact lenses and contact lens packages which comprise a hydrophobic material have a reduced tendency to stick together relative to other silicone hydrogel contact lenses in similar hydrophobic packaging materials. In particular, the present packages and silicone hydrogel contact lenses do not require a surfactant or a surface modification to reduce the tendency of the lens to stick to a surface of the package. Thus, the present packages provide multiple benefits compared to existing packages, such as reduced manufacturing efforts by eliminating the need to provide surface contours on the bottom surface of the contact lens package cavity, and the potential for reduced amounts of surfactant present in the liquid medium containing the contact lens.

In one embodiment, a contact lens package comprises a base member; a liquid medium; and a silicone hydrogel contact lens. In this embodiment, the base member comprises a hydrophobic material and has a bottom surface and a sidewall contacting the bottom surface to form a cavity. The liquid medium is located in the cavity. The silicone hydrogel contact lens is located in the liquid medium. The silicone hydrogel contact lens comprises a material effective in reducing the tendency for the lens to stick to the bottom surface of the cavity without requiring an anti-attachment agent selected from the group consisting of a surfactant, a surface modification of the bottom surface, and a combination thereof, to reduce the tendency of the lens to stick to the bottom surface. The lens and package can be formed from a variety of materials as desired, and the package may have additional elements, as disclosed herein.

In another embodiment, a holder for a contact lens is provided. The holder generally comprises a base member comprising a cavity having an opening and sized to contain a contact lens in contact with, for example immersed in, a liquid medium, for example a sterile solution. The base member further comprises a flange region including a first flange surface at least partially surrounding the opening of the cavity and a substantially opposing second flange surface. The base member further comprises a grip region spaced apart from the cavity opening and including a first grip surface and a substantially opposing second grip surface.

In one such embodiment, the first grip surface extends away from the cavity opening at an angle, for example, to define a continuous curved angle away from the cavity opening. Preferably, the first grip surface extends away from the cavity opening at an angle of greater than 0° and less than 90° relative to a plane containing the cavity opening. Even more preferably, the first grip surface extends away from the flange region at an angle of between about 10° or about 20° or about 30° and about 60°, or about 70° of about 80° relative to a plane containing the cavity opening. For example, the first grip surface extends away from the cavity opening at an angle of about 45° relative to a plane containing the cavity opening.

The first grip surface may be a curved surface. For example, the first grip surface may be concave along a major portion of the surface. In some embodiments, the first flange surface is substantially flat and the first grip surface is a curved surface substantially directly adjacent the first flange surface. The first grip surface is located in a recessed position with respect to the first flange surface. The first grip surface may have a contoured shape substantially complementary to the shape of a surface of a human thumb, for example a surface of a tip portion of an adult human thumb. For example, the first grip surface is at least partially defined by a generally spherical surface region. In some embodiments, the first grip surface is defined substantially entirely by a curved surface, for example a surface that is curved in two directions. The first grip surface may be a concave surface.

In some embodiments, the grip region further comprises a second grip surface substantially opposing the first grip surface. Preferably the second grip surface is curved, for example, is convex.

The second grip surface may include a contoured shape substantially complementary to and/or conforming to the first grip surface.

The grip region may further comprise at least one ridge raised from the first grip surface and having a curved length. The grip region may further comprise at least one ridge raised from the second grip surface and having a curved length. The raised ridge of the first grip surface may substantially oppose the raised ridge of the second grip surface.

In one embodiment, the holder is structured and shaped to facilitate comfortable, natural, firm gripping of the holder by a thumb and forefinger of a contact lens wearer. In this embodiment, the first grip surface, which is located on a top side of the grip region, is defined by a concavely curved surface shaped to comfortably accommodate a tip region of a thumb of a human hand. The first grip surface includes embossed or raised portions, for example, one or more ridges, for facilitating manual gripping of the holder. The second grip surface, which is located on an underside of the grip region, opposite the first grip surface, is defined by a convexly curved surface shaped to comfortably accommodate a surface of a crooked or curved forefinger of the same human hand. In this embodiment, the second grip surface is spaced apart from the second surface of the cavity so as to allow sufficient area for placement of the curved human forefinger therebetween. The second grip surface also includes embossed or raised portions, for example, one or more ridges, for facilitating gripping. The raised surfaces on the first grip surface and the raised surfaces on the second grip surface may comprise raised segments having curved lengths.

The base member further comprises a peripheral ridge located at an outer edge of the flange region. The peripheral ridge extends substantially perpendicular to the first flange surface.

In some embodiments, the cavity includes a substantially flat or planar bottom surface which is circumscribed by a curved side surface. The curved side surface may be defined by a generally spherical surface region. In one aspect of the invention, the cavity is contoured to enable a contact lens wearer to remove a contact lens from the cavity by means of the wearer's fingertip, for example, when the cavity is approached from substantially any rotational angle. For example, the curved region is defined by a uniformly sloped, generally frusto spherical, surface region. For example, the cavity may be somewhat dome shaped, with a flattened bottom surface. Preferably, the curved side surface is defined by a substantially uniform radius of curvature about the generally planar surface region. The cavity is preferably substantially entirely defined by the generally planar region and a generally frusto spherical surface region.

In some embodiments, at least a portion of the cavity surface is textured. The texture is effective to inhibit adherence of the contact lens to the surface of the generally planar region. For example, in one embodiment, the curved side surface of the cavity is smooth relative to the bottom surface of the cavity which is textured. In some embodiments, the planar bottom surface includes a finely ridged or grooved, for example, striated textured surface. As discussed herein, these features may not be required in silicone hydrogel contact lenses that are formed of a material that is effective in reducing the tendency of the silicone hydrogel lens to stick to the surface of the cavity.

The present packages further provide such a holder as described elsewhere herein which includes a contact lens immersed in liquid medium, and a cover assembly secured to the flange region to sealingly close the cavity having the contact lens and liquid medium therein. In some embodiments, the cover assembly comprises a first member sealingly enclosing the cavity and a second member secured to the base member and at least partially covering the first member. For example, in one embodiment, the cover assembly includes a first member sealingly covering the cavity but not the first grip surface and a second member covering the first member and at least a portion of the first grip surface, for example, the entirety of the first grip surface.

In another aspect, the cavity is sized and shaped to accommodate a single contact lens immersed in solution, and is sized and shaped to facilitate removal of the contact lens from the cavity. The cavity is preferably structured to accommodate a lens in a free floating position within the cavity and solution. By "free floating" is meant that the contact lens moves freely in the solution without significantly adhering to surfaces of the cavity.

In yet another aspect, the cover assembly comprises a first member sealingly enclosing the cavity. In another embodiment, the cover assembly comprises the first member sealingly enclosing the cavity and a second member secured to the base member and at least partially covering the first member. The second member may be removably attached to the base member so as to provide a protective, sanitary cover over both the grip surface region and the first member in order to maintain sterility of these features of the invention. In some embodiments, the first cover member is smaller in size than the second cover member. For example, while the first cover member is sized to overlay and seal the cavity opening, the second cover member is sized to overlay and seal the entire upper surface of the base member, including the cavity, the peripheral region and the grip surface region.

Each and every feature described herein, and each and every combination of two or more of such features, is included within the scope of the present invention provided that the features included in such a combination are not mutually inconsistent. In addition, any feature or combination of features may be specifically excluded from any embodiment of the present invention.

These and other aspects of the present invention are apparent in the following detailed description and additional disclosure, particularly when considered in conjunction with the accompanying drawings in which like parts bear like reference numerals.

DETAILED DESCRIPTION

Figure 1:
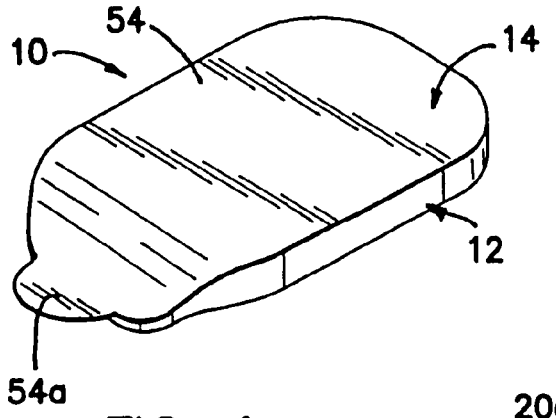
FIG. 1 is a perspective view of a contact lens package comprising a base member and a sealing assembly, in accordance with an embodiment of the present invention.

Turning now to FIG. 1, a contact lens package, in accordance with the present invention, is shown generally at 10.

The package generally comprises a base member 12 and a cover assembly 14. The invention will be more clearly understood and appreciated with reference to FIG. 2 which shows the package 10 shown in FIG. 1 with the cover assembly 14 removed from the base member 12. As shown, the base member 12 includes a cavity 18 for containing a contact lens (not shown) immersed in an amount of a solution. The term "contact lens" as used herein is intended to embrace an ophthalmic lens which, after its removal from a mold assembly in which it is made, is of a structure, size, shape and power that it can be worn on or in the eye of an individual. The base member 12 further includes a peripherally located flange region 20 at least partially surrounding an opening of the cavity 18, and a grip region 22 which is recessed with respect to the flange region 20. The cover assembly 12 sealingly encloses the contact lens and solution within the cavity 18.

The base member 12 is preferably formed of a plastic material which can be formed by injection molding or thermoforming. The plastic material used to make the base member is preferably polypropylene, but can comprise other similar plastic materials, such as, other polyalkylenes, e.g. polyethylene, and polybutylene; polyesters, e.g. PET; polycarbonates; or other thermoplastic materials. In certain embodiments, one or more portions of the base material, particularly in the cavity 18, has a vapor transmission of less than 10 grams/100 square inches/24 hours at 70° F. and 50 percent relative humidity.

One material for forming the base member 12 is a polypropylene homopolymer, for example Polypropylene PPH 10042, which is a nucleated antistatic homopolymer with a high melt flow index of 35 g/10 min. Polypropylene PPH 10042 is marketed by and available through Atofina Petrochemicals or Total Petrochemicals. Thus, the present contact lens packages may comprise a base member 12 formed of a hydrophobic material, such as polypropylene. In certain embodiment, the base member 12 comprises a polypropylene homopolymer having a melt flow index of about 35 g/10 min, a tensile strength at yield of 35 Mpa, an elongation at yield of about 8.5%, and/or a tensile modulus of about 1700 mPA, as determined using the ISO 527-2 method. The present material may also have a flexural modulus of about 1600 mPA as determined using the ISO 178 method, an Izod impact strength (notched) at 23° C. of about 3 kJ/m$^2$ using the ISO 180 method, a Charpy impact strength at 23° C. (notched) of about 3.5 kJ/m$^2$ using the ISO 179 method, and/or a Rockwell hardness (R-scale) of about 98 using the ISO-2039-2 method. The present materials may also have a melting point of about 165° C. using the ISO 3146 method, a density of about 0.905 g/cm$^3$, and/or bulk density of about 0.525 g/cm$^3$ using the ISO 1183 method.

The flange region 20 is preferably contiguous to the circumference of the cavity 18. The flange region 20 preferably extends about 5 mm from the opening of the cavity 18 to the grip region 22. In the embodiment shown, the overall dimensions of the package 10 are approximately 30 mm wide, about 47 mm long and about 10 mm high. It should be appreciated, however, that the package 10 can have any size and/or shape as long as the aspects disclosed elsewhere herein are met.

The cavity 18 holds in a fluid tight manner, a contact lens and solution. The cavity 18 is bounded by a seal area 25 which is part of the flange region 20. The cover assembly 14 is preferably attached to the base member 12 by heat-sealing in the seal area 25; however, induction-sealing, sonic welding or another bonding system can be used to attach the cover assembly 14 to the base member 12. The total interior volume defined by the cavity 18 and the sealing assembly 12 is about 2.2 ml.

The present invention also provides a contact lens package which includes a contact lens and an amount of solution sealed within the cavity.

In certain embodiments of the present packages, such as the embodiment illustrated in FIG. 1, the contact lenses are hydrophilic lenses. Such hydrophilic lenses may be constructed from one or more monomeric unit components, i.e., monomeric components. For example, and without limitation, the monomeric unit component may comprise hydrophilic monomers which provide —OH, —COOH, —NCO $(CH_2)_3$ (e.g., pyrrolidone) and the like groups. Examples of useful hydrophilic monomeric components include, without limitation, hydroxyalkyl methacrylates, such as hydroxyethyl methacrylate, methacrylic acid N-vinylpyrrolidone, acrylamide, alkyl acrylamides, vinyl alcohol, monomers, such as hydrophilic(meth)acrylates and the like and mixtures thereof, useful for inclusion in hydrophilic silicone polymeric materials, e.g., silicone hydrogels, silicone-containing monomers for polymerization into hydrophilic silicone polymers, siloxanes, such as organosiloxanes and the like and mixtures thereof, silicone-containing acrylates, silicone-containing methacrylates, and the like and mixtures thereof. Preferably, the lens is a hydrogel-containing lens, more preferably a silicone hydrogel-containing lens.

Ophthalmic lenses included in the packages of the present invention may include ophthalmic lenses made from biocompatible, non-hydrogel materials or components. Examples of non-hydrogel materials include, and are not limited to, acrylic polymers, polyolefins, fluoropolymers, silicones, styrenic polymers, vinyl polymers, polyesters, polyurethanes, polycarbonates, cellulosics, proteins including collagen-based materials and the like and mixtures thereof.

The fluid medium or solution contained in the cavity 18 can be any known solution useful for storing contact lenses including water, saline solutions, or buffered aqueous solutions. The contact lens and solution will preferably fill at least 50 percent, more preferably at least 70 percent, and most preferably at least 80 percent of the total volume defined by the cavity 18 and the cover assembly 14.

Figure 2:
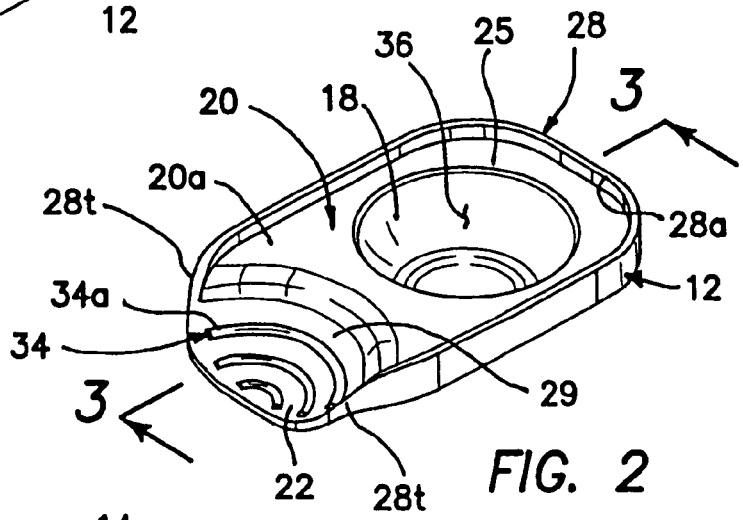
FIG. 2 is a perspective view of the contact lens package shown in FIG. 1, the package now being shown with the sealing assembly removed from the base member.
Figure 3:
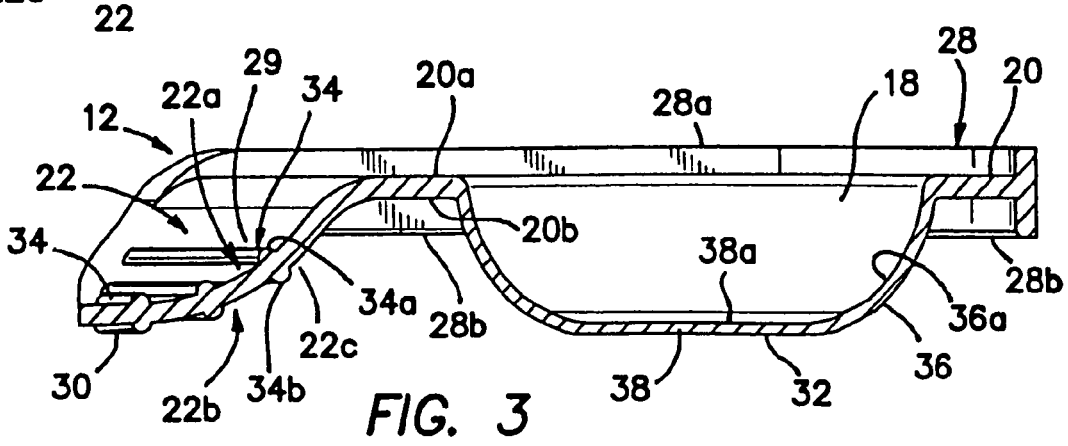
FIG. 3 is a cross sectional view of the base member shown in FIG. 2 taken along lines 3-3.

Referring now specifically to FIGS. 2 and 3, the base member 12 further comprises a rim portion 28 including an upwardly extending ridge 28*a* substantially surrounding the flange region 20. The rim portion 28 does not entirely circumscribe the holder 12. Referring now specifically to FIG. 2, the rim portion 28 tapers at opposing peripheral edges of the grip region 22 to define terminus 28t adjacent one side of the grip region 22 another opposing terminus 28t adjacent another side of the grip region 22.

In some embodiments of the present packages, the ridge 28*a* is structured to provide a barrier to contain overflow of solution, for example overflow of solution which can occur when the contact lens is being removed from the cavity 18. The rim portion 28 may further include a downwardly extending ridge 28*b*. As shown most clearly in FIG. 3, the downwardly extending ridge 28*b* downwardly extends a distance less that the depth of the cavity 18.

The grip region 22 is at least partially defined by a curved surface between the opposing peripheral edges of the grip region 22. The grip region 22 includes a first grip surface 22*a* and a substantially opposing second grip surface 22*b* (shown in FIG. 3). Similarly, the flange region 20 includes a first flange surface 20*a* and an opposing second flange surface 20*b* (shown in FIG. 3). The flange surfaces 20*a* and 20*b* are substantially planar and both of first grip surface 22*a* and second grip surface 22*b* are curved in shape.

In one embodiment, the first grip surface 22*a* extends away from the first flange surface 20*a* as a contiguous curve or slope such as shown. Preferably, the first grip surface 22*a* extends away from the first flange surface 20*a* at an angle of greater than 0° and less than 90° relative to the first flange surface 20*a*, (meaning a geometrical plane containing the first flange surface 20*a*). Even more preferably, the first grip surface extends away from the flange region at an angle of between about 30° and about 60°, for example, at an angle of about 45° relative to a plane containing the first flange surface 20*a*.

The first grip surface 22*a* may be substantially entirely concavely curved in form while the second grip surface 22*b* is substantially entirely convex in form.

In this embodiment, the first grip surface 22*a* is contoured in the form of a concavely curved "thumb grip" for facilitating manipulation of the package by a consumer. Importantly, in this embodiment, in conjunction with the concave curve of the first grip surface 22*a* for accommodating at least a portion of a human thumb, the second grip surface 22*b* is convexly curved, particularly at an inner surface portion 22c as shown in FIG. 3, to accommodate a curved or crooked forefinger of a human hand, such that the grip region 22 is easily, naturally and comfortably grippable by a consumer.

Figure 3A:
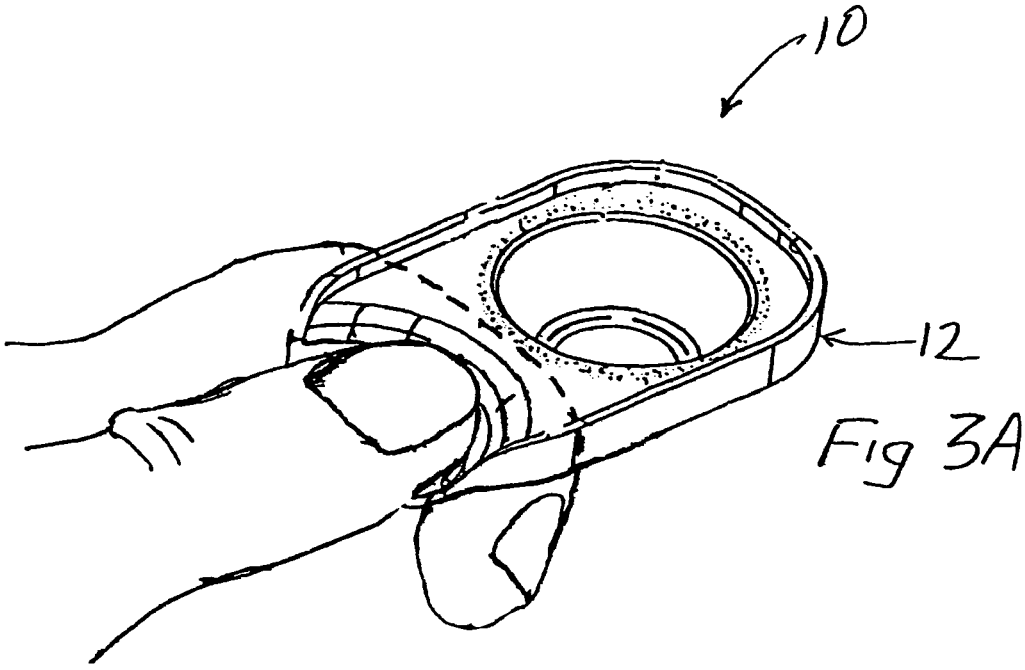
FIG. 3A is a perspective view of the contact lens package shown in FIG. 2, the package shown being gripped between a tip of a human thumb and a crooked forefinger.

These aspects of the invention will be more clearly understood with reference to FIG. 3A, which shows an adult human thumb and forefinger gripping the contact lens holder 10 in a manner that feels comfortable and secure and greatly facilitates opening of the package 10 by the consumer. As shown, the holder 10 is structured to be held by the consumer manually gripping the base 12 as shown in FIG. 3A, for example, with the left hand, while the consumer removes the sealing assembly (not shown in FIG. 3A) with the right hand.

Figure 3B:
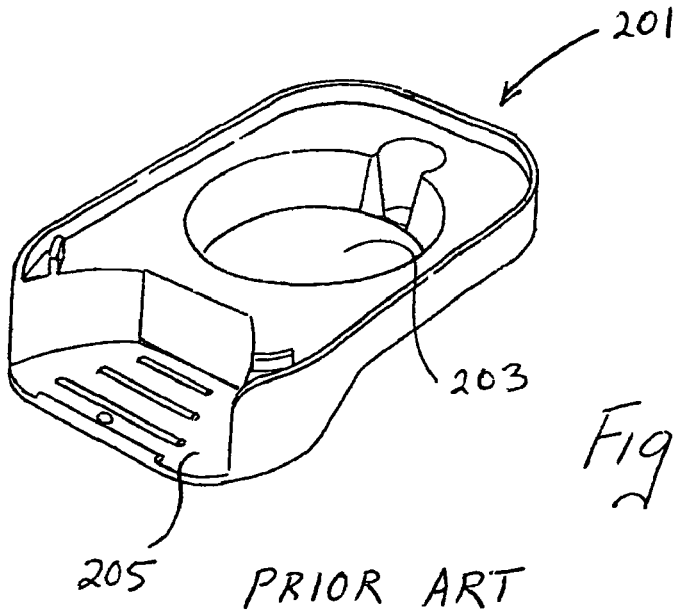
Fig 3B PRIOR ART
FIG. 3B is a perspective view of a prior art contact lens package.

This can be contrasted with a prior art contact lens package 201, shown in FIG. 3B including a well 203 for holding a lens in a fluid medium, and a tab area 205. Tab area 205 is typically gripped between a tip of a thumb and a tip of a forefinger, for example in a "pinching" fashion. This prior art package 201 can not be firmly or even comfortably gripped in the relatively more secure manner of which package 10 is designed to be gripped.

As shown, the grip region 22 is recessed sufficiently deep so that a base surface 30 of the grip region 22 is located generally level with a base surface 32 of the cavity 18. This structure also facilitates handling of the package 10. For example, the stability provided by this design reduces the chance of the contact lens or solution being spilled from the cavity after opening of the cavity 18. For example, it can be appreciated upon referring to FIG. 3 that when the package 10 is placed in an upright position on the tabletop or other level surface, the base 30 of the grip region 22 and the base 32 of the cavity 18 rest against the tabletop surface and maintain the cavity 18 in a level position. In addition, if desired, the package 10 can be opened by placing the package on a tabletop or other surface, and stabilized by pressing the grip region 22 firmly against the tabletop surface, for example using a thumb or finger. Upon so stabilizing the package, the user can then open the cavity 18 by peeling away the sealing assembly 14, for example, in a direction generally away from the grip region 22.

Figure 4:
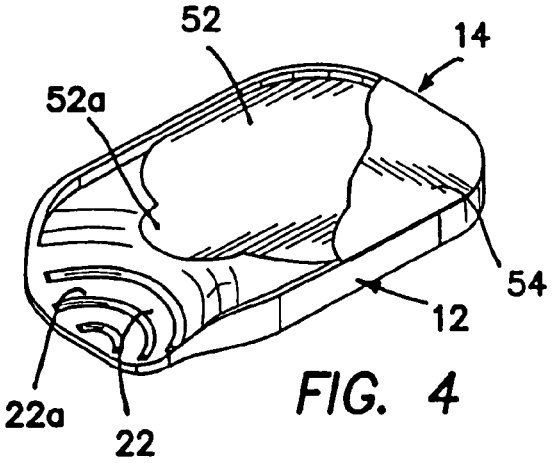
FIG. 4 shows the contact lens package shown in FIG. 1, the package now being shown with a portion of a second element of the sealing assembly cut away from the base member, thereby revealing an underlying first element of the sealing assembly.

Still referring to FIG. 3, in a related aspect, the grip region 22 comprises raised portion 34 including at least one ridge 34*a* raised from the first grip surface 22*a* and having a curved length (see FIG. 4). The grip region 22 further comprises at least one ridge 34 raised from the second grip surface 22*b* and having a curved length. In the embodiment shown, raised portion 34 includes three ridges 34*a* raised from first grip surface 22*a* and three opposing ridges 34*b* raised from second grip surface 22*b*. The raised portion 34 facilitates manual gripping of the grip region 22 by a user. The ridges 34*a* and 34*b* define curved spaced apart segments of radially concentric circles, for example substantially uniformly spaced apart segments, such as shown most clearly in FIGS. 2 and 4.

In another aspect, the cavity 18 is sized and shaped to accommodate a single contact lens immersed in solution, and is sized and shaped to facilitate removal of a contact lens from the cavity 18. The cavity 18 is preferably structured to accommodate a lens in a free floating position within the cavity and solution. By "free floating" is meant that the contact lens moves freely in the solution without adhering, in any significant degree, to surfaces of the cavity 18.

Referring to FIGS. 2 and 3, the cavity 18 is preferably defined by at least one curved region 36. The cavity 18 may be substantially entirely defined by a generally planar bottom region 38 and the curved side region 36 circumscribing the planar region 38. The generally planar region 38 may include a textured surface (texture not shown), for example a finely grooved or ridged surface, for example a striated surface, effective to reduce the possibility of the contact lens adhering to surfaces of the cavity.

In some embodiments of the invention the texture of the textured surface is visually nearly imperceptible to a naked eye of a person having substantially normal vision capabilities. In other words, the textured surface may appear smooth to a person having substantially normal vision capabilities even though the surface is textured to a significant degree in that, when compared to a relatively smoother surface, the surface will substantially inhibit adherence of the contact lens thereto.

In accordance with another aspect shown most clearly in FIGS. 2 and 3, the cavity 18 is contoured to enable a contact lens wearer to remove a contact lens from the cavity by means of the wearer's fingertip, for example, when the cavity 18 is approached from substantially any rotational angle. For example, in a preferred embodiment of the invention, the curved side region 36 has a flattened upside down dome shape, for example an inner surface 36*a* defined by a uniformly sloped, generally frusto spherical surface having a substantially uniform radius of curvature circumscribing an inner surface 38*a* of the generally planar bottom region 38. The cavity 18 is preferably substantially entirely defined by the generally planar region 38 and the generally frusto spherical surface region 36. In some embodiments of the invention, the inner surface 36*a* of the curved side region 36 is texturally smooth relative to the inner surface of the bottom region 38.

Referring now to FIGS. 1 and 4, the cover assembly 14 is illustrated as comprising at least two elements, for example at least two different, separate layers of material. For example, in the embodiment of the invention shown, the cover assembly 14 preferably comprises a first member, i.e. first layer 52, and a second member, i.e. second layer 54 overlaying the first member 52. FIG. 4 shows the package 10 with a major portion of the second member 54 removed therefrom in order to more clearly reveal the first member 52 disposed beneath the second member 54. The first member 52 may be made of a laminate material that is heat sealed to the seal region 25 of the base member 12. The second member 54 preferably comprises a foil material, sealed to the rim portion 28 of the base member 12.

The second member 54 may comprise and at least one, for example two, polymer layers, e.g. polypropylene, coating the foil. The foil may comprise aluminum. The polymer coating material on the heat seal side of the foil may be polypropylene. Examples of useful cover layers are described in U.S. Pat. No. 4,691,820 incorporated herein in its entirety by this reference. The second member 54 may be sealed to the base member 12 along an entire circumference of the base member 12 as shown in FIG. 1, so as to provide a sanitary or sterile covering, for example by means of a hermetic seal, over both the first grip surface 22*a* and the first member 52.

The present packages described hereinabove can be structured to be substantially easier to use than prior art contact lens packages. In use, for example, a user removes the second member 54 by peeling the second member 54 away from the grip region 22. This may be facilitated by tab 54*a* (FIG. 1). The user then grips the package 10 between thumb and curved forefinger, as shown in FIG. 3A, for example, with the left hand. While the package is so secured, the user then carefully peels away the first member 52 facilitated by tab 52*a* (FIG. 4), using the right hand, thereby revealing the cavity 18 and the contents therein. The contact lens can then be easily removed from the cavity 18 with a fingertip.

Figure 5:
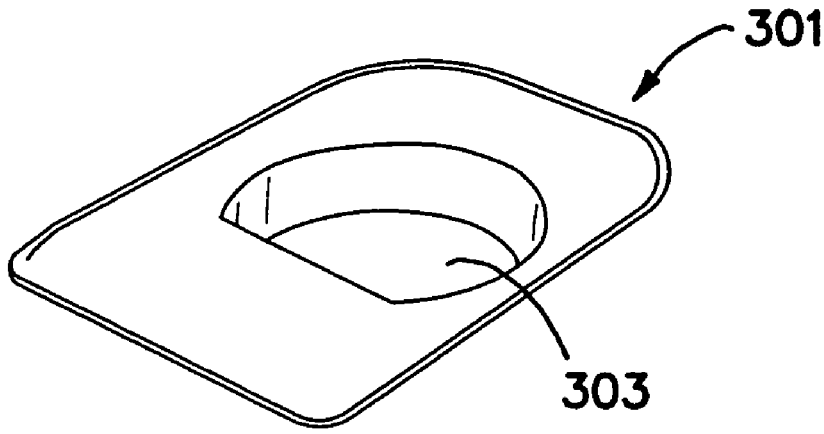
FIG. 5 PRIOR ART
FIG. 5 is a perspective view of another prior art contact lens package.

FIG. 5 illustrates another prior art contact lens package 301. Package 301 is a polypropylene blister pack that is used to contain a polyHEMA contact lens in a sterile solution in the cavity 103.

Figure 6:
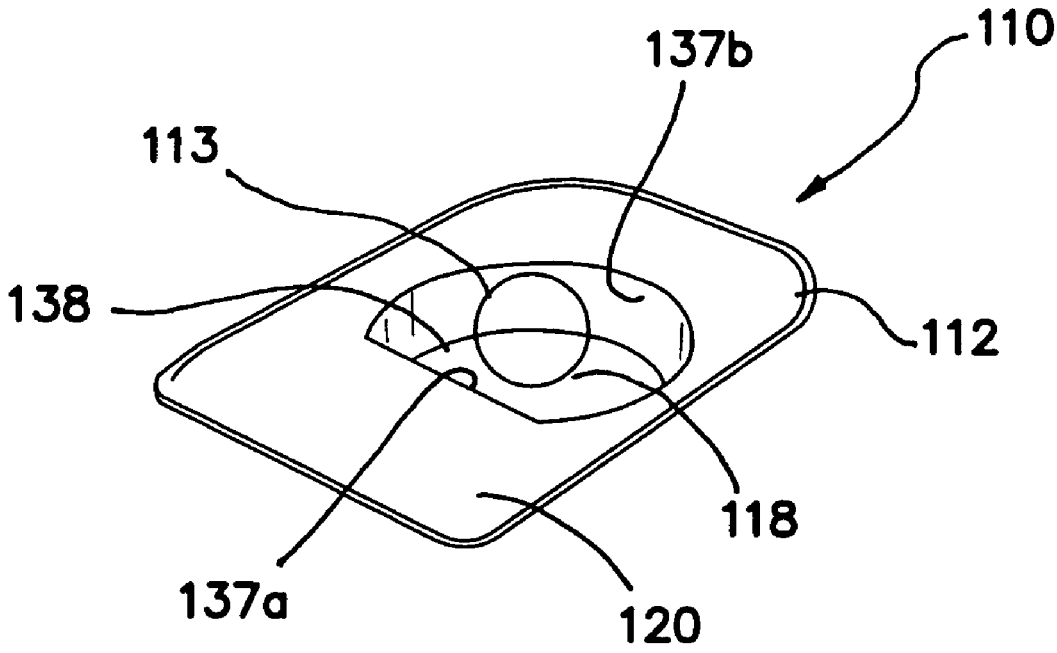
FIG. 6 is a perspective view of a contact lens package including a silicone hydrogel contact lens in a cavity of the lens package body, in accordance with another embodiment of the present invention.

FIG. 6 illustrates a contact lens package in accordance with another embodiment of the present invention. In this embodiment, the contact lens package 110 comprises a body member 112 with a cavity 118. A flange region 120 is shown extending from the cavity 118. A silicone hydrogel contact lens is shown at 113 and is provided in a liquid medium (not shown) in the cavity 118.

The contact lens package 110 is similar to the package illustrated in FIG. 5. However, the contact lens package is formed of a different grade of polypropylene than that of FIG. 5. For example, the contact lens package 110 can be formed from the polypropylene homopolymer PPH10042, disclosed hereinabove. In addition, the contact lens 113 located in the cavity 118 of the contact lens package 110 is a silicone hydrogel contact lens, and not a polyHEMA contact lens which is used in the package shown in FIG. 5.

As discussed in U.S. Patent Pub. No. 2005/0171232, it has been established that silicone hydrogel contact lenses stick to hydrophobic packaging materials, such as polypropylene-based blister packs and the like, unless a surfactant is present in the storage solution containing the silicone hydrogel contact lens. In addition, others have formed grooves or ridges on the bottom surface of the cavity of the packages to reduce the tendency for silicone hydrogel contact lenses to stick to the bottom surface of the cavity.

In contrast, it has been discovered that the present combination of hydrophobic material-based contact lens packages, such as polypropylene-based contact lens packages, and the silicone hydrogel contact lenses disclosed herein have a reduced tendency to stick or adhere to a surface forming the cavity of the present packages without requiring a surfactant or a ridge or a groove in the bottom surface of the cavity. Furthermore, the present lenses do not require a surface modification or surface treatment to make the surfaces of the lenses wettable.

Without wishing to be bound by any particular theory or mechanism of action, it is believed that the present reduced adherence is related to the enhanced wettability of the surfaces of the present lenses relative to existing silicone hydrogel contact lenses. The wettability of a contact lens surface can be related to the advancing contact angle and/or the difference between the advancing contact angle and receding contact angle (e.g., hysteresis). The present contact lenses, even without a surface treatment, have an advancing contact angle less than existing silicone hydrogel contact lenses. For example, the present lenses have an advancing contact angle less than 66°. In certain embodiments, the advancing contact angle is less than about 60°, for example, the advancing contact angle may be about 55° or less. In contrast, existing silicone hydrogel contact lenses have an advancing contact angle greater than 66°. In addition, the present contact lenses can have a hysteresis less than about 18°. In certain embodiments, the hysteresis is less than about 15°, such as less than about 10°. In certain embodiments, the hysteresis of the present contact lenses is about 5.0° or less. These values can be measured using the captive bubble method in phosphate buffered saline.

Thus, a mechanism for the reduced adherence of the present lenses can be attributed to the enhanced wettability of the surfaces of the present contact lenses relative to the wettability of the surfaces of other different silicone hydrogel contact lenses that are made of different materials and/or in different contact lens molds. For example, the present contact lenses may have a reduced advancing contact angle and/or hysteresis relative to existing silicone hydrogel contact lenses.

Therefore, in accordance with another embodiment of the present packages, it can be understood that a contact lens package comprises a base member having a cavity, a liquid medium located in the cavity, and a silicone hydrogel contact lens located in the liquid medium.

In this embodiment, such as shown in FIG. 6, the base member comprises a hydrophobic material. The base member has a bottom surface 138 and a sidewall 136 contacting the bottom surface 138 to form a cavity 118.

In the illustrated embodiment, the hydrophobic material comprises a polyolefin polymeric material. For example, the hydrophobic material of the base member may be a polypropylene polymer. Thus, the base member can be understood to be a molded polypropylene element.

In certain embodiments, such as the package 110, the bottom surface 138 is devoid of a ridge or a groove. In additional embodiments, the bottom surface 138 has a planar surface topography. Thus, it can be understood that the bottom surface 138 is smooth, and may cause other silicone hydrogel contact lenses to stick to the surface in the absence of any surface modification or the presence of a surfactant.

A liquid medium, such as a sterile packaging solution, is contained in the cavity. The liquid medium can include saline, a buffer, and other suitable components, including wettability enhancing agents and the like. In certain embodiments, the liquid medium is free of a surfactant, such as a surfactant-free medium. In other embodiments, the liquid medium comprises an amount of a surfactant effective to enhance the wettability of the silicone hydrogel contact lens contained in the liquid medium. This amount may be understood to be a wettability enhancing amount of the surfactant, and this amount can be different than the amount used to reduce the tendency of the silicone hydrogel contact lens to stick to the package.

Thus, in one embodiment, the liquid medium of the present packages comprises saline. The liquid medium may also comprise a phosphate buffer. For example, the liquid medium may be a phosphate buffered saline.

The silicone hydrogel contact lenses in this embodiment comprise a material effective in reducing the tendency for the lens to stick to the bottom surface of the cavity without requiring an anti-attachment agent selected from the group consisting of a surfactant, a surface modification of the bottom surface, and a combination thereof, to reduce the tendency of the lens to stick to the bottom surface. Thus, the present silicone hydrogel contact lenses can comprise a material that is different than existing silicone hydrogel contact lenses, such as those materials disclosed in U.S. Pat. Pub. No. 2005/0171232. The reduced tendency to stick associated with the present lenses may be relative to the tendency to stick for different silicone hydrogel contact lenses formed of different materials.

In certain embodiments, the silicone hydrogel contact lens of the present packages has an advancing contact angle of less than about 66°, or less than about 60°, or less than about 55°, and/or a hysteresis less than about 18°, or less than about 10°, or less than about 5°, as described herein. It is believed that the enhanced wettability of the present contact lenses compared to other different silicone hydrogel contact lenses may contribute to the reduced tendency of the silicone hydrogel contact lens to stick to a surface of the cavity of the present packages. In certain embodiments, the present contact lenses comprise contact lens forming materials, as disclosed in U.S. Application No. 60/604,961, filed Aug. 27, 2004 and U.S. Application No. 60/621,525, filed Oct. 22, 2004. For example, some of the present silicone hydrogel contact lenses comprise a plurality of silicon-containing macromers. In certain lenses, the lenses comprise a combination of a polymethylsiloxane methacrylate derivative and a polysiloxanyl dimethacrylate. The lenses may also comprise other components useful in forming silicone hydrogel contact lenses, including without limitation, sulfosuccinates, isocyantes, pyrrolidonones, methacrylates, and acetamides. Silicone hydrogel contact lenses that comprise materials with a reduced tendency to stick to a hydrophobic packaging material without requiring a surfactant or surface modification of a surface of the cavity, can be produced using materials suitable for silicone hydrogel contact lenses and routinely tested for sticking by placing the lenses in the present packages and liquid media. In addition, such lenses can be selected based on the desired advancing contact angle and/or hysteresis, as described herein.

As shown in FIG. 6, the base member 112 of the present packages 110 can comprise a flange 120 extending from the cavity. The flange can be held by a person when removing the contact lens from the package.

The present packages 110 may also comprise a seal similar to that described for the other embodiments herein. The seal can be a cover assembly such as that described in FIGS. 1 and 4 herein. The seal is attached to the base member to maintain the contact lens in a sterile environment until ready for use by a person.

The present packages may comprise a cavity defined by a sidewall that has at least one planar surface 137*a* and at least one curved surface 137*b*, each of which is substantially perpendicularly oriented to the bottom surface 138 of the cavity 118. Alternatively, the present packages may comprise a sidewall that is oriented at a non-perpendicular angle to the bottom surface 138, such as the curved surface 36 shown in FIG. 3.

In view of the disclosure herein, the present silicone hydrogel contact lenses can be understood to have a reduced tendency to become attached to the bottom surface of the package body or cavity relative to different silicone hydrogel contact lenses formed of different materials, wherein the reduced tendency is substantially unaffected by the presence of a surfactant in the liquid medium.

The base members of the present packages can be formed using conventional techniques of forming contact lens packages. For example, the base members can be formed using injection molding or thermomolding techniques. In certain situations, the base members will be formed in a strip of two or more base members attached to each other. In one embodiment, the three base members are attached along an edge to form a strip of three blister packs. The cavity in each base member is filled with a liquid medium suitable for storing contact lenses, such as silicone hydrogel contact lenses, in a sterile condition. In certain embodiments, the medium is a surfactant-free medium. In other embodiments, the medium comprises a wettability enhancing amount of a surfactant. After inspecting and placing a contact lens in the liquid medium of a cavity, the base member is sealed, and may be labeled for distribution, storage, and the like.

The contact lenses may be removed from the package by removing the seal and taking the lens out of the liquid medium and placing the lens on or in an eye of an individual.

Certain aspects and advantages of the present invention may be more clearly understood and/or appreciated with reference to the following commonly owned United States Patent Applications, filed on even date herewith, the disclosure of each of which is being incorporated herein in its entirety by this specific reference: U.S. patent application Ser. No. 11/200,848, entitled "Contact Lens Molds and Systems and Methods for Producing Same"; U.S. patent application Ser. No. 11/200,648, entitled "Contact Lens Mold Assemblies and Systems and Methods of Producing Same"; U.S. patent application Ser. No. 11/200,644, entitled "Systems and Methods for Producing Contact Lenses from a Polymerizable Composition"; U.S. patent application Ser. No. 11/201,410, entitled "Systems and Methods for Removing Lenses from Lens Molds"; U.S. patent application Ser. No. 11/200,863, entitled "Contact Lens Extraction/Hydration Systems and Methods of Reprocessing Fluids Used Therein"; U.S. Patent Application No. 60/707,029, entitled "Compositions and Methods for Producing Silicone Hydrogel Contact Lenses"; and U.S. patent application Ser. No. 11/201,409, entitled "Systems and Methods for Producing Silicone Hydrogel Contact Lenses".

While this invention has been described with respect to various specific examples and embodiments, it is to be understood that the invention is not limited thereto and that it can be variously practiced within the scope of the following claims.

What is claimed is:

1. A contact lens package, comprising a base member comprising a hydrophobic material and having a bottom surface and a sidewall contacting the bottom surface to form a cavity;

a liquid medium located in the cavity; and a silicone hydrogel contact lens without a surface treatment, having an advancing contact angle of less than 66° and located in the liquid medium, the silicone hydrogel contact lens comprising a material effective in reducing the tendency for the lens to stick to the bottom surface of the cavity without requiring an anti-attachment agent selected from the group consisting of a surfactant, a surface modification of the bottom surface, and a combination of a surfactant and a surface modification of the bottom surface, to reduce the tendency of the lens to stick to the bottom surface.

2. The package of claim 1, wherein the hydrophobic material comprises a polyolefin polymeric material.

3. The package of claim 1, wherein the hydrophobic material comprises a polypropylene material.

4. The package of claim 1, wherein the base member is a molded polypropylene element.

5. The package of claim 1, wherein the base member further comprises a flange extending from the cavity.

6. The package of claim 1, wherein the sidewall comprises at least one planar surface and at least one curved surface, each surface substantially perpendicularly oriented to the bottom surface of the cavity.

7. The package of claim 1, wherein the sidewall is oriented at a non-perpendicular angle to the bottom surface.

8. The package of claim 1, wherein the bottom surface is devoid of a ridge or a groove.

9. The package of claim 1, wherein the bottom surface has a planar surface topography.

10. The package of claim 1, wherein the liquid medium comprises saline.

11. The package of claim 1, wherein the liquid medium comprises a phosphate buffer.

12. The package of claim 1, wherein the liquid medium is free of surfactant.

13. The package of claim 1, wherein the liquid medium comprises an amount of a surfactant effective in enhancing the wettability of the contact lens.

14. The package of claim 1, further comprising a seal attached to the base member to maintain the liquid medium in a sterile condition.

15. The package of claim 1, wherein the silicone hydrogel contact lens has an advancing contact angle of less than 60°.

16. The package of claim 1, wherein the silicone hydrogel contact lens has a hysteresis less than about 18°.

17. The package of claim 1, wherein the silicone hydrogel contact lens has a hysteresis less than about 15°.

18. The package of claim 1, wherein the silicone hydrogel contact lens has a hysteresis less than about 10°.

19. The package of claim 1, wherein the silicone hydrogel contact lens has a hysteresis about 5° or less.

* * * * *

UNITED STATES PATENT AND TRADEMARK OFFICE

CERTIFICATE OF CORRECTION

PATENT NO. : 7,426,993 B2
APPLICATION NO. : 11/200862
DATED : September 23, 2008
INVENTOR(S) : Coldrey et al.

It is certified that error appears in the above-identified patent and that said Letters Patent is hereby corrected as shown below:

Title Page of Patent

Column 1, item (73) Assignee: "Coopervision International Holding Company, LP" should read --CooperVision International Holding Company, LP--.

Column 13, line 7

A paragraph present in the patent application, as filed, and missing from the patent should read as follows:

--A number of publications and patents have been cited hereinabove. Each of the cited publications and patents are hereby incorporated by reference in their entireties.--.

Signed and Sealed this

Eleventh Day of May, 2010

David J. Kappos

David J. Kappos
*Director of the United States Patent and Trademark Office*